US006959738B2

(12) United States Patent
Wahhoud et al.

(10) Patent No.: US 6,959,738 B2
(45) Date of Patent: Nov. 1, 2005

(54) METHOD AND APPARATUS FOR ENTANGLING FILAMENTS IN A WEFT YARN ON A WEAVING LOOM WITH PNEUMATIC WEFT INSERTION

(75) Inventors: Adnan Wahhoud, Lindau (DE); Matthias Armbrust, Wangen (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 234 days.

(21) Appl. No.: 10/377,269

(22) Filed: Feb. 28, 2003

(65) Prior Publication Data

US 2003/0164197 A1 Sep. 4, 2003

(30) Foreign Application Priority Data

Mar. 1, 2002 (DE) ..... 102 09 278

(51) Int. Cl.[7] ..... D03D 47/34
(52) U.S. Cl. ..... 139/450
(58) Field of Search ..... 139/450, 435.2, 139/11, 116.1; 28/220, 258; 57/333, 353

(56) References Cited

U.S. PATENT DOCUMENTS 4,256,148 A * 3/1981 Scharling, II ..... 139/450
5,295,516 A * 3/1994 Tanaka et al. ..... 139/452
5,937,915 A 8/1999 Wahhoud
6,240,977 B1 * 6/2001 Gilpatrick ..... 139/450

FOREIGN PATENT DOCUMENTS

DE 19653028 1/1998
JP 03161557 7/1991

* cited by examiner

*Primary Examiner*—Danny Worrell
(74) *Attorney, Agent, or Firm*—W. F. Fasse; W. G. Fasse

(57) ABSTRACT

The filaments in a weft thread or yarn in a pneumatic loom are tangled and consolidated to prevent untangling of the weft thread when it is transported, after the tangling, through the weft insertion channel in a loom shed. For this purpose the leading end of the weft thread is temporarily stopped in a weft insertion nozzle pipe by a first air stream the so-called holding air stream (19) with a first pressure (P1) between two weaving cycles following each other for holding the weft thread stretched. At the same time a second air stream (20) having a higher pressure (P2) than the first pressure (P1) and a different flow direction than the first air stream (19) is applied to or along a leading end portion of the weft thread for tangling the filaments and thereby locking or consolidating the filaments in the weft thread. Each weft insertion nozzle pipe has a first port and a second port through which the first and second air streams are introduced into the weft insertion the nozzle pipe. The second port is positioned downstream of the first port and closer to a free exit end (15) of the respective weft insertion nozzle pipe but still spaced from the free exit end.

12 Claims, 2 Drawing Sheets

FIG. 3
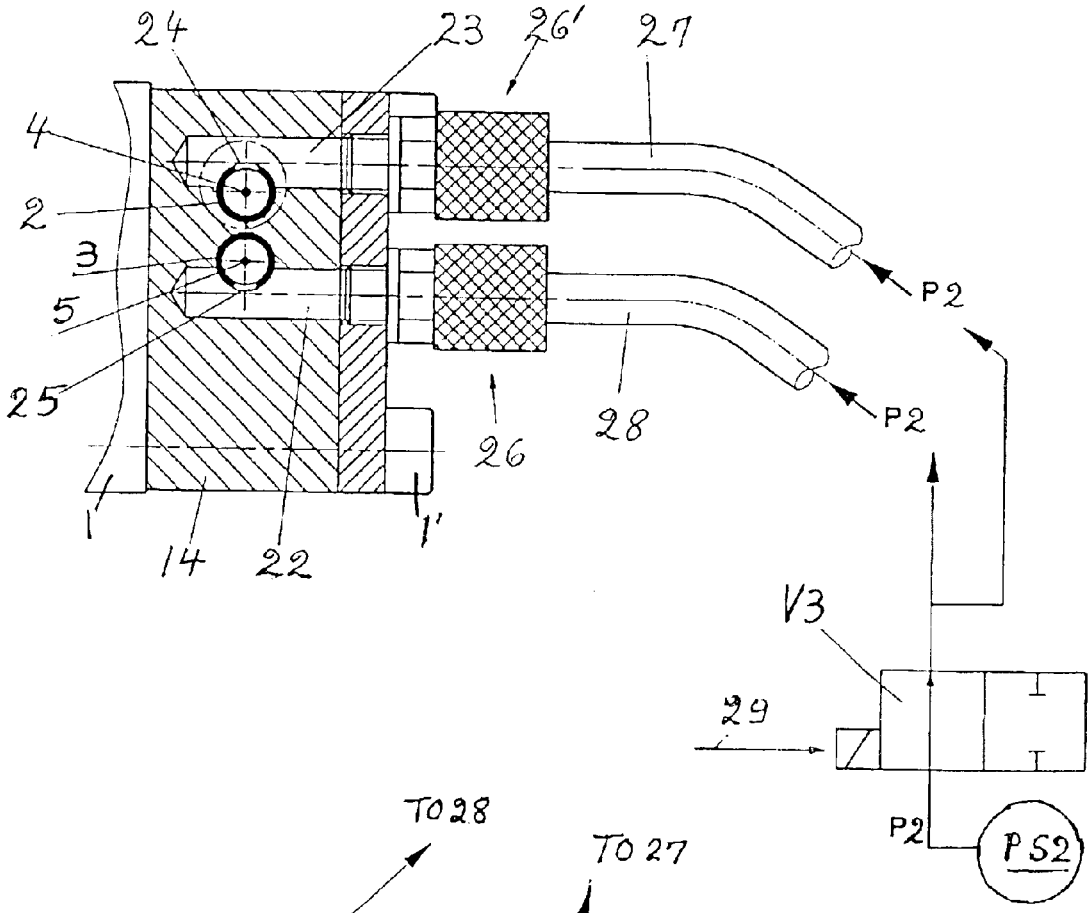
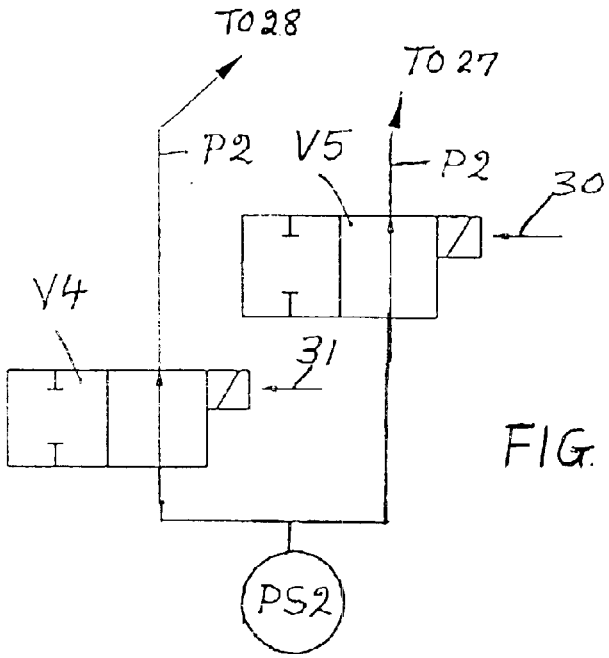
FIG. 4

METHOD AND APPARATUS FOR ENTANGLING FILAMENTS IN A WEFT YARN ON A WEAVING LOOM WITH PNEUMATIC WEFT INSERTION

PRIORITY CLAIM

This application is based on and claims the priority under 35 U.S.C. §119 of German Patent Application 102 09 278.8, filed on Mar. 1, 2002, the entire disclosure of which is incorporated herein by reference.

FIELD OF THE INVENTION

The invention relates to a method and apparatus for entangling the filaments in a weft yarn or thread on its way through a weft insertion nozzle pipe that feeds the respective weft yarn or thread into a weft insertion channel through the loom shed or reed. The weaving loom is equipped with weft supply components and pneumatic weft insertion components.

BACKGROUND INFORMATION

Japanese Patent Publication 3-161557 discloses a weaving loom with pneumatically functioning weft thread insertion devices.

The device of the Japanese Patent Publication comprises a main weft insertion nozzle (4), a suction nozzle (12) for holding the rear end of a weft yarn or thread that has already been inserted into the weft insertion channel. The leading end of the inserted weft yarn is held by a clamp 9 at the exit side of the loom shed. In this state of the weft yarn the rear end of the weft yarn is consolidated by a gyrating twister air flow in a twister nozzle (13), for a trouble-free weaving by preventing untangling of the weft yarn forming filaments, at the rear end of the weft yarn. The suction nozzle (12) and the twister nozzle (13) are separate but aligned components. The twister air flow is effective on the rear end of the weft yarn.

When filament weft yarns of different qualities are to be woven into the same fabric in the same weaving operation, it is known to provide each weft thread with its own weft insertion components while one of the plurality of the weft threads is being actively transported through the weft insertion channel in the loom shed the other filament weft yarns are held in waiting and kept stretched by being exposed to an air stream also referred to as the so-called holding air stream having a predetermined pressure level while the other end of the stretched portion of the weft yarn is being held by a thread stopper or weft brake that cooperates with a weft yarn supply reel or spool also known as a storage spool or drum. The other weft threads or yarns that are held in waiting are exposed to the holding air stream in the respective weft yarn insertion nozzle pipe where they are exposed to a certain holding tension that is just sufficient to keep the weft thread stretched without moving the weft thread since its other end is still held by the weft stopper or weft brake.

The just described operation which applies a certain holding tension to the weft thread by the holding air stream, has the disadvantage that the filaments of the yarn can be untangled again at least partly by the holding tension, whereby particularly the weft thread ends may fan out which prevents an efficient application of the transport air streams to the weft yarn on its way through the weft insertion channel. More specifically, the required thread pulling force is not uniformly applied to the weft yarn which has a negative effect on the efficiency of the pneumatic weft insertion and on the quality of the woven fabric.

German Patent Publication DE 196 53 028 C1 discloses a method for weaving weft yarns that either are not tangled or only partially tangled, particularly synthetic filament weft yarns on weaving looms with a pneumatic weft insertion. The just mentioned known method tries to make synthetic filament yarns that conventionally have only a small internal cohesion or consolidation of the individual filaments in the yarn, suitable for weaving on air nozzle weaving looms. For this purpose the weft yarn is exposed to the operation of an entangling mechanism which is so positioned that it is effective on the weft yarn between the weft supply spool and an intermediate storage spool or drum which acts as an intermediate weft storage device to hold a predetermined weft thread length. When the known entangling mechanism is positioned between the supply spool and the intermediate storing spool it is not possible to take into account that the yarn, even though it has been entangled, will be exposed in the weft insertion nozzle pipe to an air stream that extends in the direction of weft insertion, namely the so-called holding air stream in order to temporarily keep the weft yarn in waiting or in a so-called starting position for the next following weft transport through the weft insertion channel through the loom shed. This co-called holding air stream has regularly the tendency to adversely affect the inner entangling of the filaments with one another by applying a tension force that wants to untangle the filaments at least along a certain length. If that certain length of untangled weft yarn is woven into the fabric, it is unavoidable to prevent the formation of filament loops at the catch or exit side of the loom shed. Such filaments loops, no matter how small, adversely affect the quality of the fabric.

OBJECTS OF THE INVENTION

In view of the foregoing it is the aim of the invention to achieve the following objects singly or in combination:

- to expose filament yarns to a two-step treatment by air streams to avoid the formation of filament loops in a weft yarn on pneumatic looms;
- to entangle at least a portion of the weft thread next to its leading end or even including the leading end so that a desired consolidation of the yarn filaments is achieved;
- to avoid pulling the tail or rear end of an inserted weft yarn by suction; and
- to provide a pneumatic loom with at least one weft insertion nozzle pipe capable of performing the present method.

SUMMARY OF THE INVENTION

The above objects have been achieved by the method according to the invention for tangling filaments of a weft yarn at least along a certain length section next to a leading end of a weft yarn thread for consolidating the filaments in the weft on a loom with a pneumatic weft insertion and with at least one weft insertion nozzle pipe through which the weft yarn is driven in each weaving cycle for passing the weft yarn through a weft insertion channel of a reed in the loom. The present method is characterized by the following steps:

(a) first exposing, during a time duration between two consecutive weaving cycles, a first point or portion along the certain length section of the weft yarn to a first air stream having a first air pressure (P1) and flowing in a first direction for holding the weft yarn stretched at least between a weft brake and the leading end of the weft yarn, (b) second exposing, within the above time duration, a second point or portion between the first point or portion and the leading end of the weft yarn to a second air stream having a second air pressure (P2) higher than said first air pressure, and (c) causing said second air stream to flow in a second direction that differs from the first direction, for tangling the filaments in the weft yarn to thereby consolidate the filaments in the weft yarn.

The foregoing method is performed by a weaving loom according to the invention which loom is characterized by at least one weft insertion nozzle pipe and weft insertion means including at least one main nozzle for passing a weft yarn through the weft insertion nozzle pipe which has a weft inlet and a weft outlet, a first pressure source for providing a first pressure (P1), a first pressure conduit (10) connecting the first pressure source (PS1) to a first inlet or port in the weft insertion nozzle pipe, a first program controllable valve (V1) in the first pressure conduit (10) for controlling a first air stream (19) directed for temporarily holding a weft thread stretched during a predetermined time duration between two weaving cycles following each other, a second pressure source (PS2) for providing a second pressure (P2) higher than the first pressure (P1), a second pressure conduit (27 or 28) connecting the second pressure source to a second port or inlet in the weft insertion nozzle pipe downstream of said first port or inlet, a second program controllable valve (V3) in the second pressure conduit for controlling a second air stream (20) directed for entangling the filaments of the weft yarn. The filaments are entangled at least along a leading end portion of said weft thread during the above time duration. Moreover, the first air stream (19) with the lower pressure has a substantially longitudinally effective direction relative to the weft yarn in the nozzle pipe while the second higher pressure air stream (20) is directed substantially perpendicularly to the length of the weft yarn in the nozzle pipe, more specifically in the same nozzle pipe.

It is an advantage of the invention that the time between two weaving cycles is effectively used to expose the leading end, or a length section or portion next to the leading end of the weft yarn, particularly filament weft yarn, to a holding air stream (19) and simultaneously a filament consolidating air stream (20) that has a higher pressure than the holding air stream and that is directed in a flow direction different from that of the holding air stream. Preferably, the first holding air stream is directed to apply a tension force to the weft yarn that will keep the portion of the weft yarn between a thread stopper or weft brake and the leading end of the weft yarn stretched while the entangling second air stream is directed perpendicularly to the longitudinal travel direction of the weft yarn. Minor angular deviations within about ±10° from the longitudinal weft yarn axis and/or from the perpendicular thereto are permissible but it is important that the two air streams have different directions.

In case, for example two or more weft yarns are held in waiting or ready for insertion, the additional exposure by the second entangling air stream can be longer than the time duration between two weaving cycles or rather longer than the duration of one weaving cycle.

The first holding air stream can have an air pressure that depends on the yarn quality, but can be relatively low, for example less than 1 bar, to be just sufficient to keep the weft yarn stretched between the weft brake and the leading weft end. On the other hand, the tangling second air stream should have a pressure that is preferably more than one bar, and still more preferably between four to six bar to assure the desired tangling and respective consolidation of the filaments in the weft yarn.

By tangling the weft yarn, or rather the filaments of the weft yarn inside the weft insertion nozzle pipe rather than outside the nozzle pipe, the invention achieves the advantage that the filaments have no chance of avoiding the second tangling air stream, whereby an effective tangling and consolidation of the weft filaments are achieved that will prevent the formation of a weft leading end that looks fanned-out.

Further it has been found to be advantageous to determine an end portion (18) next to the leading end (17) of the weft yarn so that this end portion corresponds approximately to that portion of the leading end of the weft yarn that is cut off anyway at the exit or catch end of the weft insertion channel through the loom shed. In this way it is assured that any defects that might be caused by the second consolidating air stream are cut off from the inserted weft yarn.

It has been found that weft yarns having any cross-sectional configuration can be treated as taught by the invention. The weft yarns may, for example have a flat cross-sectional configuration forming a small ribbon or a square or oval or round configuration.

BRIEF DESCRIPTION OF THE DRAWINGS

In order that the invention may be clearly understood, it will now be described in connection with example embodiments, with reference to the accompanying drawings, wherein:

FIG. 3 illustrates a sectional view along section line III—III in FIG. 1 and shows the simultaneous exposing of two weft yarns to two identical entangling second air streams; and FIG. 4 is an arrangement of valves similar to that in FIG. 1 for sequentially or alternately exposing two weft yarns to a respective entangling air stream.

DETAILED DESCRIPTION OF A PREFERRED EXAMPLE EMBODIMENT AND OF THE BEST MODE OF THE INVENTION

Figure 1:
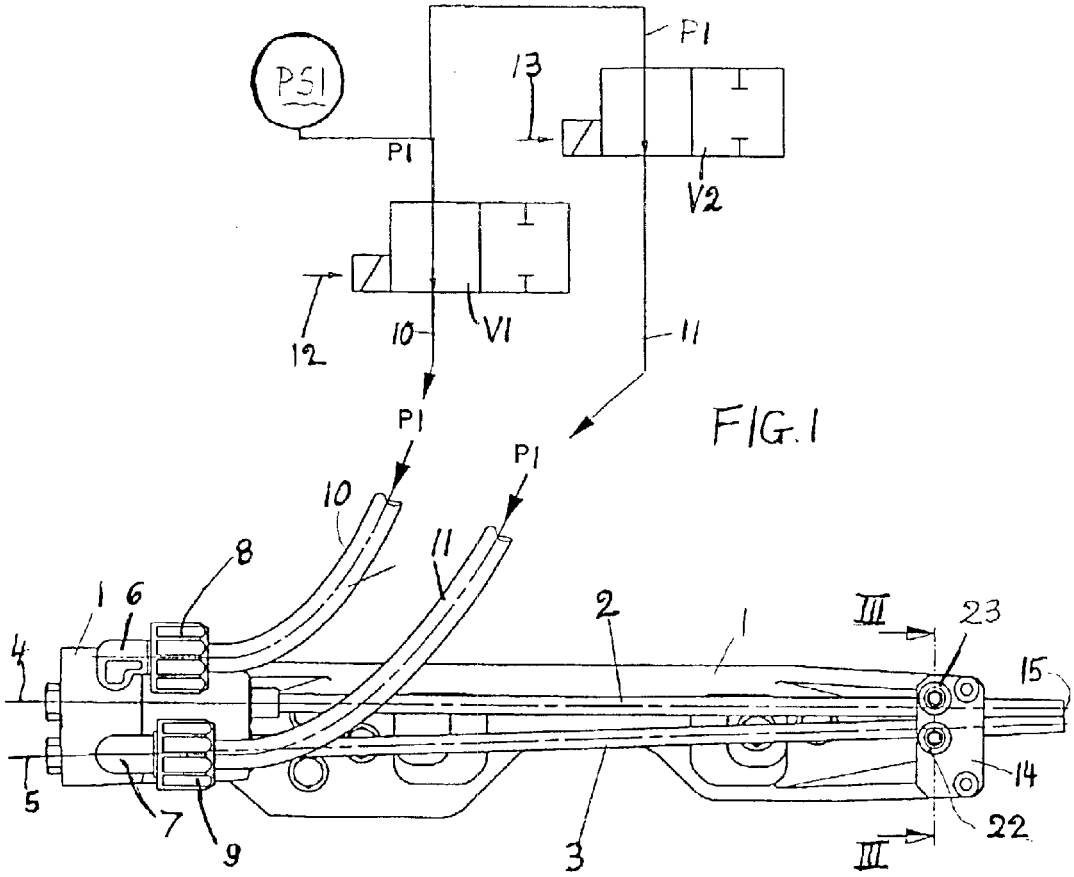
FIG. 1 shows a top plan view of two weft insertion nozzle pipes arranged next to each other and held in position by a main nozzle mounting block.

FIG. 1 shows a weft insertion main nozzle device for performing the method of the invention, including a main nozzle mounting block 1, for example, for two weft insertion nozzle pipes 2 and 3. A weft yarn 4 passes or is transported through the nozzle pipe 2. A weft yarn 5 passes or is transported through the nozzle pipe 3. The two weft yarns 4 and 5 may have different colors. It is preferred to use two nozzle pipes 2 and 3 in order to accommodate the high weft insertion capacity of an air nozzle weaving loom. Each weft yarn 4 and 5 is withdrawn from its respective weft supply spool and runs from the supply spool to an intermediate weft storage spool which temporarily stores a predetermined length of weft yarn. The storage spool is conventional and equipped with a weft stopper or weft brake. The weft supply spool, the storage spool and the weft brake are not shown since they are conventional. The mounting block 1 supports a main nozzle 6 for the weft insertion nozzle pipe 2 and a main nozzle 7 for the weft insertion nozzle pipe 3. The main nozzle 6 is connected through a coupling 8 of any suitable conventional construction and through a pressure conduit 10 to a first program controllable valve V1. The valve V1 is in turn connected to a pressure source PS for supplying a pressure P1 in a controlled manner to the first main nozzle 6. The main nozzle 7 is connected through a conventional coupling 9 and a pressure conduit 11 to a second valve V2 that is also controllable by a program that is stored in a memory section of a main loom control, not shown. The valve V2 is also connected to the pressure source PS1. Arrows 12 and 13 symbolize program responsive control input signals for the valves V1 and V2, respectively.

Referring further to FIG. 1, a connector member bracket 14 secures free ends 15 of the weft insertion nozzle pipes 2 and 3 to the mounting block 1. The connecting member 14 comprises two nozzle chambers or air inlet chambers 22 and 23 better seen in FIG. 3.

Figure 2:
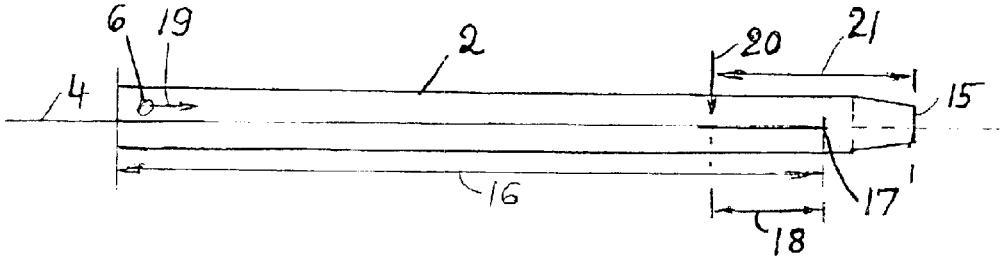
FIG. 2 illustrates schematically the various length portions of the weft yarn inside a weft insertion nozzle pipe.

FIG. 2 shows symbolically the temporarily stationary position of a certain length section 16 of the weft yarn 4 in the nozzle pipe 2 with the free weft end 17 still inside the nozzle pipe 2 during a time duration between two consecutive weaving cycles. Each weaving cycle includes a shed change, a weft insertion and a beat up motion of the reed. A first point portion along the length section 16 of the weft yarn 4 is formed by the main nozzle 6 to inject a first air stream 19 into the nozzle pipe 2. The first air stream 19 flows in a direction that is suitable to hold the weft yarn 4 in a stretched position between the above mentioned weft brake and the leading weft end 17. The first air stream 19 has a first pressure P1 sufficient to keep the weft yarn 4 stretched without moving it between two weaving cycles.

According to the invention the leading end portion 18 of the weft yarn 4 is exposed to a second air stream 20 within the same nozzle pipe 2, for example at a point upstream of the leading weft end 17. The length of the end portion 18 is selected for properly tangling and consolidating filaments of the weft yarn 4. The second point or portion is preferably located upstream of the exit end 15 of the nozzle pipe 2 by a spacing 21. The second air stream 20 has a pressure P2 that is larger than the pressure P1 as will be explained in more detail below with reference to FIG. 3. The air stream 20 is directed in a second direction that differs from the first direction of the first air stream 19 so that the second air stream 20 may sufficiently tangle the filaments in the weft yarn at least at the above defined second point for consolidating the filaments.

By using two valves V1 and V2 that are individually controllable by the control signal 12 and 13 and by also using two nozzle pipes 2 and 3, it is possible to perform a weaving operation with a so-called mixing change over, whereby the length section 16 of the weft yarn 4 is held stationary in one nozzle pipe 2 while the weft yarn 5 in the nozzle pipe 3 is transported through the weft insertion channel in the loom shed and vice versa. Both air streams 19 and 20 and thus both pressure levels P1 and P2 are applied to the stationary weft yarn inside the time duration between two weaving cycles. Preferably, the pressure level P1 is less than one bar while the second pressure level P2 is higher than one bar, preferably within the range of four to six bar. The duration for which the weft thread is kept stationary is determined by the time duration available between two weaving cycles which in turn is determined by a respective angular range of the rotation of the main loom drive shaft.

FIG. 3 is a sectional view along section line III—III in FIG. 1 and illustrates further details of the connector member or bracket 14 with its two air inlet chambers 22 and 23. The nozzle pipe 2 is provided with a port 24 leading into the chamber 23. The nozzle pipe 3 is provided with a port 25 leading into the chamber 22. The chamber 22 is connected through a conventional coupling 26 to a pressure conduit 27 which in turn is connected to a valve V3 through which the second air stream 20 is supplied into the chamber 22 from a second pressure source PS2. The air chamber 23 is connected through a conventional coupling 26 and a pressure conduit 27 to the same valve V3 to also receive the second air stream 20 with a pressure P2. The valve V3 is controllable through a program responsive control signal 29.

It has been found that it is possible to expose both weft yarns 4 and 5 simultaneously to the second air stream 20 provided separately for each weft yarn 4 and 5 as shown in FIG. 3 as long as the weft insertion into the loom shed takes place alternatingly or in sequence. It is preferred to operate the valve V3 for controlling the flow of the second air stream or streams 20 in a pulsating manner which assures a strong consolidation of the filaments in the weft yarn 4 and 5 to thereby prevent an unraveling or untangling of the weft yarn during the following weft insertion.

FIG. 4 shows a possibility of using two valves V4 and V5 for independently controlling two separate air streams 20. The two valves V4 and V5 are connected with their inlet ports in common to the second pressure source PS2 for alternatingly supplying the second air stream with its second pressure P2 into the air chambers 22 and 23 under the control of program responsive control signals 30 and 31 applied to second air stream flow control valves V5 and V4, respectively.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for tangling filaments of a weft yarn at least in a certain length section next to a leading end of said weft yarn for consolidating said filaments in the weft yarn on a loom with a pneumatic weft insertion and with at least one weft insertion nozzle pipe through which said weft yarn is driven in each weaving cycle for passing said weft yarn through a weft insertion channel of a reed in said loom, said method comprising the following steps:

(a) first exposing, during a time duration between two consecutive weaving cycles, a first point or portion positioned along said length section of said weft yarn to a first air stream (19) having a first air pressure (P1) and flowing in a first direction for holding said weft yarn stretched, (b) second exposing, within said time duration a second point or portion between said first point and said leading end of said weft yarn to a second air stream (20) having a second air pressure (P2) higher than said first air pressure, and (c) causing said second air stream (20) to flow in a second direction that differs from said first direction, for tangling said filaments and thereby consolidate said filaments in said weft yarn.

2. The method of claim 1, further comprising keeping said first pressure (P1) lower than one bar and keeping said second air pressure higher than one bar.

3. The method of claim 1, further comprising keeping said second pressure (P2) within the range of 4 to 6 bar.

4. The method of claim 1, further comprising performing said second exposing step at said second point or portion which is spaced from a free exit end (15) of said at least one weft insertion nozzle pipe (2, 3).

5. The method of claim 1, further comprising controlling said second air stream (20) to form air stream impulses and performing said second exposing step by directing said air stream impulses to said second point or portion.

6. The method of claim 1, further comprising determining a location of said second point or portion so close to said leading end of said weft yarn that said point or portion is in a yarn waste length that will be cut off at a catch end of said weft insertion channel when said pneumatic weft insertion is completed.

7. The method of claim 1, wherein said first and second steps of exposing are applied to weft yarns of any cross-sectional configuration and particularly to synthetic filament weft yarns.

8. The method of claim 1, further comprising determining said time duration as an angular range of a rotation of a main drive shaft of said loom.

9. A weaving loom comprising at least one weft insertion nozzle pipe and weft insertion means for passing a weft yarn through said weft insertion nozzle pipe (2), said weft insertion nozzle pipe including a weft inlet and a weft outlet, a first pressure source (PS1) for providing a first pressure (P1), a first pressure conduit (10) connecting said first pressure source to a first port in said weft insertion nozzle pipe, a first program controllable valve (V1) in said first pressure conduit (10) for controlling a first air stream (19) directed for temporarily holding a weft thread stretched during a predetermined time duration between two weaving cycles following each other, a second pressure source (PS2) for providing a second pressure (P2) higher than said first pressure (P1), a second pressure conduit (27) connecting said second pressure source (PS2) to a second port in said weft insertion nozzle pipe downstream of said first port, a second program controllable valve (V3) in said second pressure conduit (27) for controlling a second air stream (20) directed for entangling filaments of said weft yarn.

10. The weaving loom of claim 9, wherein said first and second ports are so positioned in said same weft insertion nozzle pipe (2) that said first air stream (19) and said second air stream (20) have different directions relative to a longitudinal weft insertion direction.

11. The weaving loom of claim 9, wherein said first pressure source provides said first pressure (P1) at less than one bar, and wherein said second pressure source provides said second pressure (P2) at more than one bar.

12. The weaving loom of claim 9, further comprising at least two weft insertion nozzle pipes (2, 3) arranged alongside each other, wherein each of said at least two weft insertion nozzle pipes comprises said first and second port, to provide two first ports and two second ports with said second ports being positioned closer to a free nozzle pipe end (15) than said first ports.

* * * * *